United States Patent [19]

Hanson et al.

[11] 4,068,337

[45] Jan. 17, 1978

[54] ANKLE PAD FOR FOOTWEAR

[75] Inventors: Alden B. Hanson; Chris A. Hanson; Donald W. Bertetto, all of Boulder, Colo.

[73] Assignee: Hanson Industries Inc., Boulder, Colo.

[21] Appl. No.: 766,148

[22] Filed: Feb. 7, 1977

Related U.S. Application Data

[62] Division of Ser. No. 664,042, March 4, 1976, Pat. No. 4,019,266.

[51] Int. Cl.[2] ..... A43D 9/00

[52] U.S. Cl. ..... 12/142 P

[58] Field of Search ..... 36/71, 117, 118, 119, 36/120, 121; 12/142 R, 142 P, 1 R, 146 R

[56] References Cited

U.S. PATENT DOCUMENTS

| | | | |
|---|---|---|---|
| 2,918,734 | 12/1959 | Hyde | 36/71 |
| 3,237,319 | 3/1966 | Hanson | 36/71 |
| 3,521,385 | 7/1970 | Dalebout | 36/120 |
| 3,529,368 | 9/1970 | Canfield | 36/71 |
| 3,548,420 | 12/1970 | Spence | 36/71 |
| 3,750,310 | 8/1973 | Messner et al. | 36/119 |
| 3,798,799 | 3/1974 | Hanson et al. | 36/71 |
| 3,848,286 | 11/1974 | Kahmann | 12/142 P |
| 3,882,561 | 5/1975 | Hanson et al. | 12/142 P |
| 4,019,266 | 4/1977 | Hanson et al. | 36/119 |

*Primary Examiner*—Patrick D. Lawson

*Attorney, Agent, or Firm*—Merriam, Marshall & Bicknell

[57] ABSTRACT

An ankle pad for use in a ski boot having a shell and a flexible liner disposed within said shell, the ankle pad being less dense than the density of the liner material and being adapted to fit in a recess located in the liner in the area where the ankle joint of a wearer contacts the liner.

2 Claims, 6 Drawing Figures

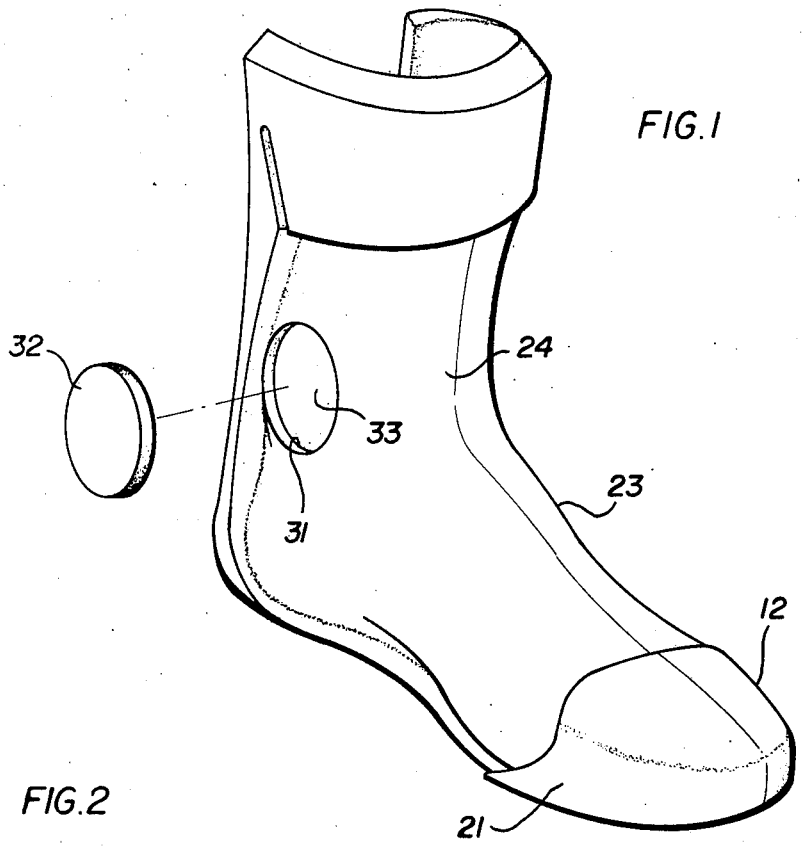
FIG.1
FIG.2
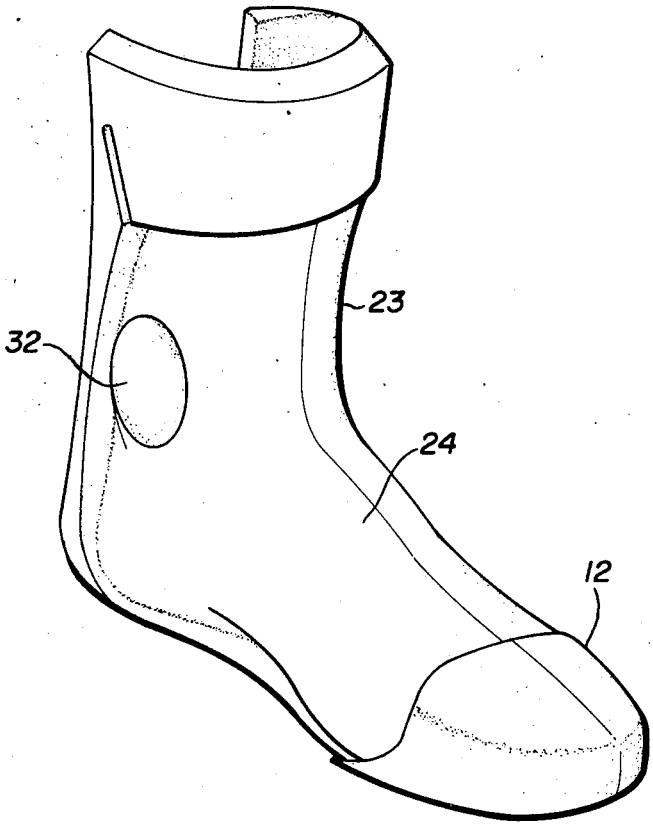
FIG.5
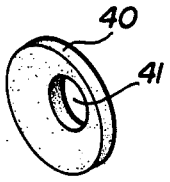
FIG.6
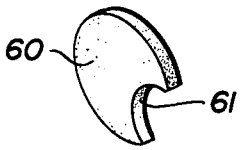

ANKLE PAD FOR FOOTWEAR

This is a division of application Ser. No. 664,042, filed Mar. 4, 1976, now U.S. Pat. No. 4,019,266, The present invention relates to a ski boot and liner assembly for ski boots and more particularly to a pad for use with the liner to provide increased comfort for the wearer of the ski boot.

BACKGROUND OF THE INVENTION

Ski boots presently available generally comprise a relatively rigid outer shell which is typically molded of plastic. Disposed within the outer shell is an inner member or liner which is relatively soft and flexible, as compared to the shell. The boot also has one or more buckles or other suitable fastening means for opening and closing the boot.

Prior art liners comprise many designs, however, the purpose of all these designs is to provide a ski boot with a liner assembly in which the assembly provides both padding for comfort of the wearer's foot while at the same time fitting the boot to the wearer's foot.

One liner assembly presently available serves to provide a padding function for the foot while at the same time providing for the custom fitting of the boot to the wearer's foot. This liner assembly is disclosed more fully in U.S. Pat. No. 3,798,799. The liner assembly disclosed in that patent is made up of an inner padding member and a relatively non-compressible fitting material. The inner padding member of the liner assembly comprises a molded padding member which is adapted to fit within a substantially semi-rigid outer shell. The outer surface of the inner padding member is generally complimentary to the inside of the outer shell and the inner surface of the inner padding member is adapted to surround the wearer's foot and ankle. The inner padding member is shaped to provide one or more cavities on its outer surface which cavities are adapted to be filled with a fitting material. A fitting material of the type described in U.S. Pat. No. 3,798,799 is inserted in these cavities to complete the liner assembly.

It has been found that, in some instances, the liner area surrounding the ankle joint of the wearer has not provided the desired level of comfort to the wearer. That portion of the liner has, unfortunately, caused an excessive amount of pressure against the ankle joint area of the wearer's foot. Accordingly, it is desired to obviate this source of discomfort, however, it is important that structural integrity of the liner assembly not be affected. In this respect it has been found that if an area of a liner assembly is removed, it is important that no sharp or prominent break in the liner structure be permitted because, over a period of time, this break in the liner structure will be sensed by a wearer with the result being that this will serve as a source of discomfort to the wearer. Therefore, it is required that the ankle joint area of a ski boot which has been the source of discomfort, in some instances, be minimized without causing any sharp or prominent break in the liner assembly.

SUMMARY OF THE PRESENT INVENTION

With the view of obviating the problems sometimes found with liner assemblies presently available with ski boots, the invention disclosed and claimed herein involves the use of ankle pads which are utilized with liner assemblies presently available to provide the necessary comfort to a wearer. The liner member is recessed. In placing a recess in the joint area of the liner member, however, a liner membrane is maintained in the liner in the recessed area so that no discontinuity or irregularity in the inner liner surface will occur. Within the recessed area, an ankle pad is inserted. The ankle pad can be made of a number of materials that will provide the desired cushioning effect, but has a slow memory or recovery rate. In other words, after the ankle pad is depressed, it does not immediately spring back into shape but goes back to its original shape relatively slowly. The use of a pad employing material having these characteristics is disclosed in U.S. Pat. No. 3,529,368.

The ankle pad is placed within the recessed area of the liner. Preferably the ankle pad, when loosely inserted in the liner assembly, will project out beyond the outer surface of the liner; however, when the boot is thereafter fitted with a fitting material such as shown and disclosed, for example, in U.S. Pat. No. 3,798,799, the ankle pad thickness will be compressed into the recess to substantially fill the recessed area whereby a wearer of the boot will not normally sense an irregularity of break in the liner assembly.

Additional embodiments of the ankle pad allow for the pads to have a hole or cut out in them whereby the pad can be oriented within the recessed area so that the pad opening or cut out will properly accommodate a portion of the ankle joint of the wearer. The ankle pad having the opening or cut out will be rotated or otherwise moved to a position whereby the outer most protrusion of the ankle joint will be located at the area of the opening or cut out.

The present invention serves to provide the desired comfort in the area of the ankle joint of a wearer while at the same time maintaining the integrity of the liner assembly whereby a wearer will not sense any irregularity or break in the liner assembly. Other features and advantages are inherent in the structure claimed and disclosed and will become apparent to those skilled in the art from the following detailed description in conjunction with the accompanying diagrammatic drawings.

BRIEF DESCRIPTION OF THE DRAWINGS

FIG. 1 shows an inner pad liner member with an ankle joint pad disposed outside of said inner liner member;

FIG. 2 shows an inner liner member with the ankle pad disposed within the recess formed in the inner pad member in the area of the ankle joint of a wearer;

FIG. 5 shows a second embodiment of an ankle pad of the present invention; and, FIG. 6 shows yet another embodiment of an ankle pad of the present invention.

Figure 4:
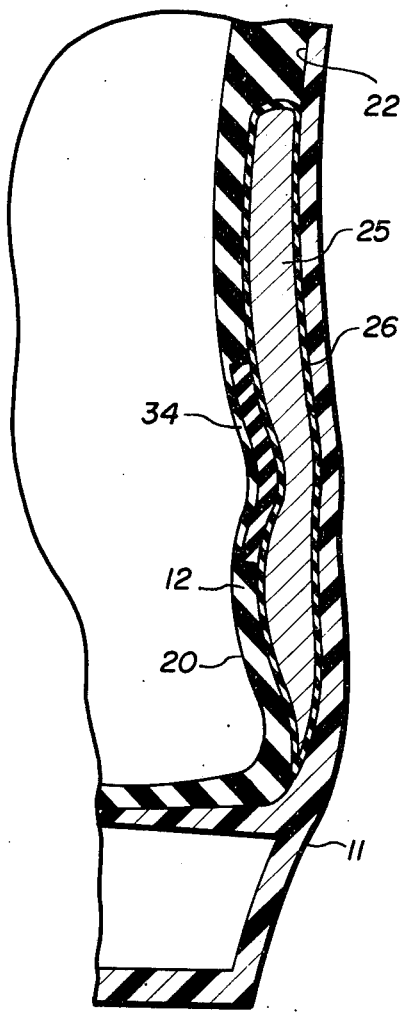
FIG. 4 shows a partial section view taken along lines 4—4 in FIG. 3 and showing the inner padding member, ankle pad, filling material and shell.

Referring to the drawings there is shown a ski boot 10 comprising an outer rigid plastic shell 11, a liner 14 connected to the back or wall 13 of tongue member 15. Access to the rear entry boot is accomplished by pivoting tongue member 15 outwardly, away from shell 11. The foot of a wearer is then inserted into boot 10 from the rear. Subsequently, tongue member 15 is pivoted back to where it is partially overlapped on both sides by the rear portion of the shell 11. Boot 10 is then buckled by inserting loops 17, 17*a* into buckle members 16.

Figure 3:
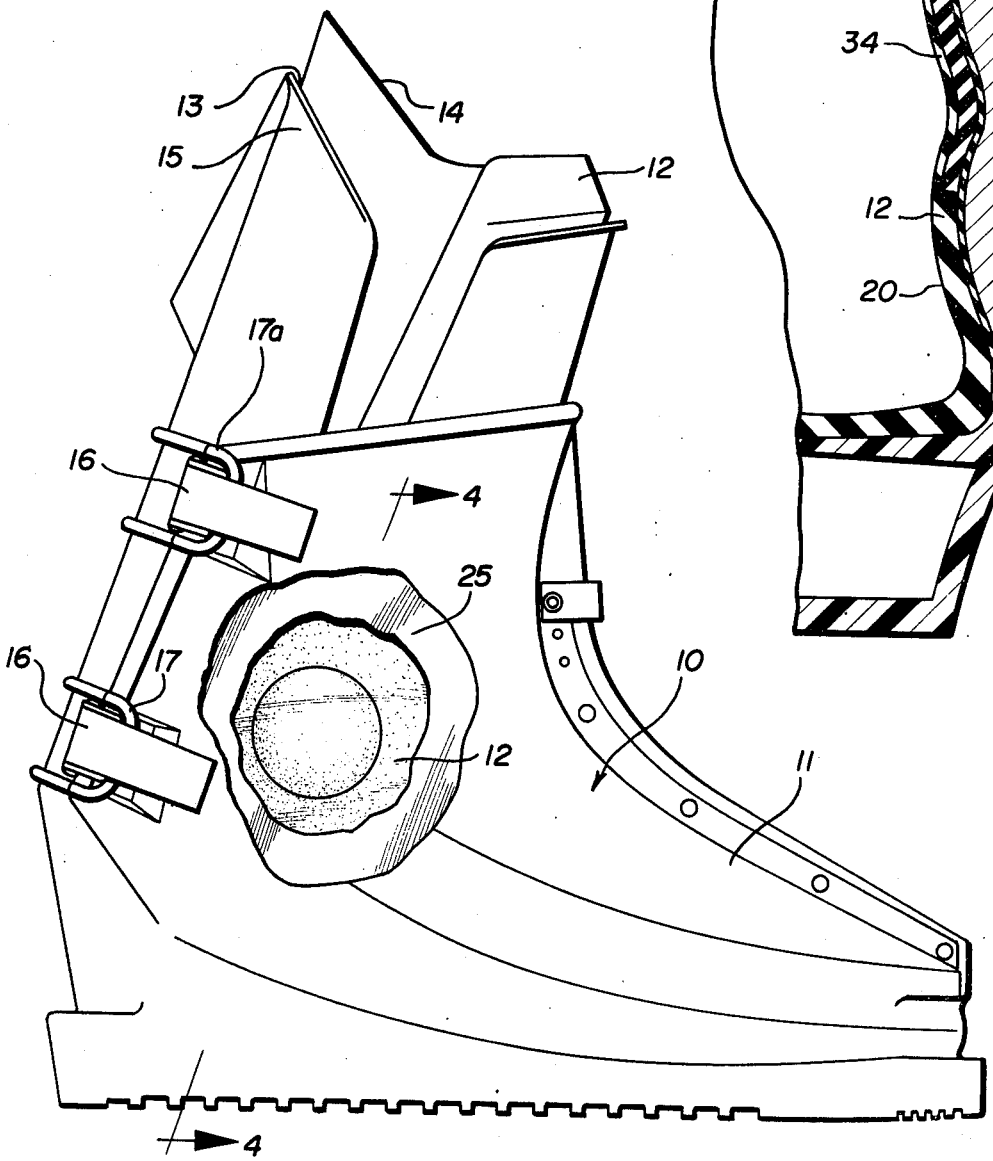
FIG. 3 shows a side view of a ski boot with the boot shown cut away in the area of the ankle joint of a wearer.

Inner padding member 12 is designed to cover substantially all of the foot and ankle of a wearer except for the back of the ankle and achilles tendon area. The area not covered by inner padding member 12 is padded by tongue liner 14 of rigid tongue member 15, as illustrated in FIG. 3 and further shown in U.S. Pat. No. 3,798,799. Liner 14 is shaped to mate the inner padding member 12, whereby inner padding 12 and tongue liner 14 will combine to enclose the entire foot and ankle of the wearer.

Inner surface 20 of inner padding member 12 is shaped generally to conform to the contour of a wearer's foot. Outer surface 21 of inner padding member 12 is preferably shaped to fit substantially to the inner surface 22 of shell 11 except in the area of cavity 23, which serves to provide a space for filling material 25 between the shell and inner padding member when inner padding member 12 is inserted in shell 11. The fitting material is illustrated in FIG. 4 as being disposed within a bladder or other filling container 26; however, if desired, the filling material could be disposed within the area formed by cavity 23, shell 11 and liner member 12 without being enclosed in a separate container.

The thickness of the cross section of the inner padding member 12 in the area bounded by cavity 23 may be approximately ¼ inch, whereas the thickness of a cross section through the remainder of member 12 may be approximately ½ inch. The inner padding member is preferably a flexible, cushion member which serves to provide desired padding between the foot and the fitting material. Thus, the fitting material does not provide the padding function but the fitting material provides a support function, whereby it provides support for the skier's foot and ankle and firm contact between the foot and ski boot outer shell. In carrying out the support function, the fitting material obviates substantial movement of the foot within the ski boot, thus providing good control of the skis for the skier. The filling material for the boot is one which is flowable at elevated temperatures. For example, a wax or a mixture of a wax and plasticizer can be employed as further described in U.S. Pat. No. 3,798,799.

Liner member 12 may be made from various materials which will be known to those skilled in the art. Basically, the member must have a smooth inner surface, free from wrinkles or similar irregularities. The substance of the liner is desirably flexible, in order that it may be deformed to fit the wearer's foot during the fitting process. While the inner liner member may be produced from a number of materials, such as polyurethane elastomers (both high and low density), polybutadiene homopolymers and copolymers (foamed or solid), foamed rubber, polyvinyl chloride and the like, polyurethane foam has been found to be particularly satisfactory. It has been found that a relatively thin urethane foam padding member will accomplish the required padding function, since the accurate fit achieved by the fitting process will reduce the need for massive padding.

Referring to FIG. 1, it will be seen that the liner member 12 has been recessed at 31 in the area of the ankle joint. While only one recess has been shown, it is appreciated that the area of the ankle joint on the opposite side of the liner is also normally recessed. The recess preferably does not extend all the way through liner 12 in order that the integrity of inner surface 20 of liner 12 is not disturbed. It has been found that if the remaining liner membrane 34 is approximately one-sixteenth inch, satisfactory results are achieved.

Subsequently, an ankle pad 32 is placed in the cavity 33. The ankle pad is a cushioning material and comprises a closed cell polyvinyl chloride foam. The material has a slow memory or recovery rate, so that once it is depressed, it returns to its original shape relatively slowly. If desired, a suitable adhesive can be applied to maintain the pad in the recess of the liner once the pad is properly positioned. A material for the ankle pads of the present invention is available from Blanchard Industries, 179 Main St. W. Orange, N.J. 07052, under the registered trademark "Foamgard" and is further described in Blanchard Bulletin Number 7.11/BL. Other materials having slow memory characteristics have been described in U.S. Pat. No. 3,529,368, which relates to pads for use in ski boots.

Preferably, the thickness of pad 32 is slightly greater, as for example one-sixteenth inch to ⅛ inch, than the maximum thickness of cavity 33. Further, the density of pad 32 is less than the density of liner member 12. It has been found that the density of the material of liner member 12 in the area of the ankle joint is approximately 35 pounds/cubic foot, whereas the density of the ankle pad material 32 is approximately 13 pounds/cubic foot. Accordingly, a density ratio of about 1 to 2.7 of the ankle pad material to the liner material prior to the insertion of the pad in recess 33, has been found to be satisfactory. It is appreciated that when the pad is inserted in the recess, the compression of the pad will change this density to approximately 1 to 2.5, depending upon the thickness of the ankle pad, the recess and the foot of the wearer of the boot.

In the course of a fitting operation, ankle pad 32, prior to the filling material 25 being placed in the area founded by cavity 23, will extend slightly beyond outer surface 24 of cavity 23. However, when filling material is placed in cavity 23, pad 32 will be compressed an substantially flattened so that it minimizes the break in the surface of the liner member at the area of recess 33.

When wax is used as a filling material, a pad preferably having the density of liner member 12 will initially be inserted in recess 33. This dense pad will be approximately the same thickness and shape as the thickness and shape of recess or cavity 33. Subsequently, wax filling material number 25 will be placed in the boot in a manner such as shown and disclosed in U.S. Pat. No. 3,876,746. After the wax has solidified sufficiently, the dense pad will be removed and ankle pad 32 comprising the less dense material previously described will be inserted in recess 33. The use of the dense pad during fitting precludes the wax filling material from filling the cavity or recess 33 which would possibly occur if the lower density pad 32 is placed in recess 33 when the wax material initially is put into the boot in a flowable state.

While the ankle pad shown in FIGS. 1 and 2 is a solid member, other embodiments can be used. In FIG. 5 pad 40 is shown with hole 41 offset from the center of the pad. FIG. 6 shows an embodiment of a pad 60 having a U-shaped cut out 61. With the pads shown in FIGS. 5 and 6, it has been found that in the course of a fitting operation during which time a wearer's foot is inside the boot liner 12, a pad of the type shown in FIGS. 5 and 6 can be rotated in recess 33 relative to the ankle joint of a wearer to accommodate different shape joints. The pads are rotated relative to the ankle joint of the wearer so that the maximum outward protrusion of the joint is located in the area of the opening 41 or cut out 61. It has been found with ankle pads such as 40 and 60 that fitting material 25 need not fill the area of opening 41 or 61; however, in some cases, the liner member 12 will possibly require some grinding along the edge of the liner at the location of recess 33 and the cut out to maintain a surface which will not cause discomfort to a wearer of the boot.

When a wax or other fitting material is used with the low density ankle pad embodiments of FIGS. 5 and 6, a dense pad will initially be placed in recess 33 during the fitting operation as previously described.

One ankle pad size that has been found satisfactory is $\frac{1}{4}$ inch thick and $1\frac{3}{4}$ inches in diameter. The density of the material in an uncompressed state is 13 pounds/cubic foot. The ankle pad fits in a liner member recess which has a maximum recess thickness of about three-sixteenths inch.

While one example of an ankle pad material has been disclosed, it is appreciated the ratio of liner to pad material can be altered to fit the specific needs of a particular application, however, it is desirable to provide an ankle pad material which will give a ratio of liner to pad material that will be the optimum ratio for most applications.

Although a dense pad is used initially in a fitting operation where wax is the fitting material, it is appreciated that with other fitting materials the use of a dense pad may not be necessary in the fitting operation.

The foregoing detailed description has been given for clearness of understanding only and no unnecessary limitations should be understood therefrom, as modificiations will be obvious to those skilled in the art.

What is claimed is:

1. The method of fitting a ski boot comprising a shell, a liner having a recess, and a filling material adapted to be disposed between said shell and liner; said method comprising the steps of:

inserting said liner having said recess in the shell of a ski boot;

placing in said liner recess a first pad having a density of at least the density of said liner;

inserting filling material between said liner and said shell;

removing said first pad from said recess; and, inserting in said liner recess a second pad having a density less than the density of said liner.

2. The method of fitting a ski boot comprising a shell, a liner having a recess in the ankle joint area, and a filling material adapted to be disposed between said shell and liner; said method comprising the steps of:

inserting in the shell of the ski boot said liner having said recess in the ankle joint area of the liner;

placing in said liner recess a first pad having a density of at least the density of said liner;

inserting filling material between said liner and said shell;

removing said first pad from said recess; and, inserting in said liner recess a second pad having a density less than the density of said liner, and a pad thickness which is larger than the thickness of the depth of said liner recess.

* * * * *